US006681952B2

(12) United States Patent
Mowe

(10) Patent No.: US 6,681,952 B2
(45) Date of Patent: Jan. 27, 2004

(54) BRUSH WIPER AND HOLDER FOR PAINT CAN

(76) Inventor: Kelly L. Mowe, 842 Maxie La., Lawrenceville, GA (US) 30044

( * ) Notice: Subject to any disclaimer, the term of this patent is extended or adjusted under 35 U.S.C. 154(b) by 0 days.

(21) Appl. No.: 10/262,043

(22) Filed: Sep. 30, 2002

(65) Prior Publication Data

US 2003/0121925 A1 Jul. 3, 2003

Related U.S. Application Data

(60) Provisional application No. 60/343,349, filed on Dec. 31, 2001.

(51) Int. Cl.[7] ..... B65D 25/42
(52) U.S. Cl. ..... 220/697; 220/700; 220/730
(58) Field of Search ..... 220/697, 698, 220/699, 700, 736

(56) References Cited

U.S. PATENT DOCUMENTS 2,518,214 A * 8/1950 Worthington ..... 220/630
2,803,374 A * 8/1957 Cash ..... 220/696
2,903,154 A * 9/1959 Hendershot ..... 220/697
3,428,213 A * 2/1969 Stephens ..... 220/697
3,688,943 A * 9/1972 Brown ..... 220/697
4,266,686 A * 5/1981 Carter ..... 220/697
4,275,818 A * 6/1981 Church ..... 220/697
5,033,704 A * 7/1991 Kerr ..... 248/110
5,568,879 A * 10/1996 Kovathana ..... 220/697
5,913,450 A * 6/1999 Runkel ..... 220/696

* cited by examiner

*Primary Examiner*—Joseph Man-Fu Moy
(74) *Attorney, Agent, or Firm*—Harry I. Leon; Vivian L. Steadman

(57) ABSTRACT

A paint brush wiper and holder for a paint can which is removably mountable thereon whether the can is open or closed. The brush wiper and holder includes a short, cylindrical sidewall for partially capping the paint can and a lip which extends inwardly and generally perpendicularly to the sidewall. A promontory-like protrusion on the lip extends inwardly from the remainder of the lip and slopes downwardly therefrom, so that paint collected on the protrusion can drain into an open paint can. The leading edge of the promontory-like protrusion is both sharpened and generally convex in shape, so that it can serve as an efficient brush wipe. As the bristles of a brush are pressed against this leading edge, they spread open, fan-like, releasing excess paint. Affixed to the lip near the mid-section of the promontory-like protrusion and projecting generally upwardly of the sidewall is a pair of bowed plastic arms which exhibit leaf spring action or similar releasable fasteners. Spaced apart from and in opposition to each other, the plastic arms hold a paint brush handle firmly in place. The brush can be removed from the arms without jerking it by grasping its handle and rotating it upwardly, pressing the bristles against the promontory-like protrusion, so that any paint on the brush is retained thereon as it is being freed.

3 Claims, 2 Drawing Sheets

BRUSH WIPER AND HOLDER FOR PAINT CAN

PREVIOUS APPLICATION

Applicant claims benefits under Title 35, U.S. 119(c) for U.S. Provisional Patent Application having Ser. No. 60/343,349 filed Dec. 31, 2001.

BACKGROUND OF THE INVENTION

A need exists for a paint brush holder removably mountable atop a paint can which can be used to keep the brush and paint can together between painting jobs and which directs any excess paint the brush might hold away from the brush handle.

SUMMARY OF THE INVENTION

The primary object of this invention is to provide an improved paint brush holder removably mountable atop a paint can with or without its paint can lid being secured thereto.

A further object of the invention is to provide such a holder with a rest on which a paint brush can be held generally horizontally, excess paint on the brush draining back into the can when its lid is open.

A still further object of this invention is to provide an improved paint brush holder in combination with an efficient brush wipe which can be employed as a marketing gimmick for selling paint, the resultant brush wiper and holder being an inducement for buyers to purchase a particular brand of paint.

In accordance with the present invention, there is provided a brush wiper and holder (hereinafter "brush holder") having a short, cylindrical sidewall and an inner annular ring. Attached along its outer periphery to the sidewall, the ring, which extends generally perpendicularly thereto, includes a short section to which is joined a promontory-like protrusion. The protrusion, which slopes slightly downwardly from the annular ring, terminates inwardly with a first arcuate inner edge. Other than along the short section, the annular ring is bounded by a downwardly turned rim which defines a second arcuate inner edge. Together the first and second arcuate inner edges define an asymmetrical opening which is disposed within the annular ring.

In use, the short, cylindrical sidewall is slideably fitted over the top of the paint can, partially capping it. When the paint can is open, the asymmetrical opening is situated upwardly of the space formerly occupied by the paint can lid, so that any paint draining from the rim can be captured in the paint can.

Beneath the upper surface of the promontory-like protrusion, the first arcuate edge is preferably sharpened, sloping downwardly and away from the asymmetrical opening at an angle of about 45 degrees. Stroking the bristles of a paint brush across the first arcuate edge subjects them to a superior wiping action in which they are spread apart, fan-like, to release excess paint.

Affixed to the upper surface of the lip proximate with the mid-section of the promontory-like protrusion and projecting generally upwardly from the lip near its juncture with the side-wall is a pair of bowed plastic arms with leaf spring action or similar releasable fasteners. Spaced apart from each other, the plastic arms hold a paint brush firmly in place, when its handle is inserted therebetween. The paint brush can be removed from the arms by grasping its handle and rotating it upwardly, pressing the bristles against the promontory-like protrusion in the process. This technique allows one to remove the brush without having to jerk it so that any paint held on the brush is retained thereon rather than being accidentally discharged.

DETAILED DESCRIPTION OF THE PREFERRED EMBODIMENT

Figure 1:
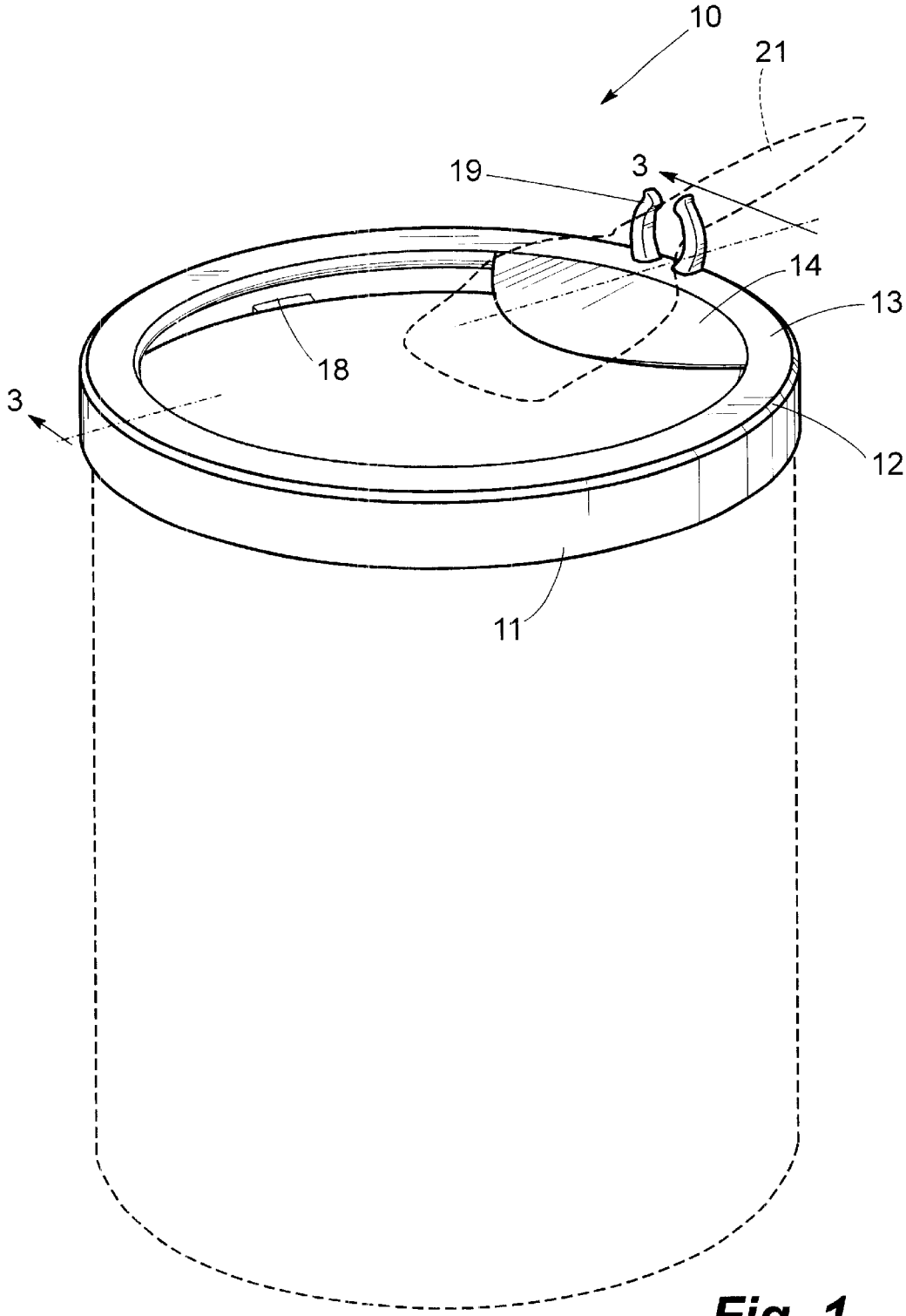
FIG. 1 is a perspective view of the top right side of a brush wiper and holder in accordance with the present invention, a paint can and brush being shown in dashed lines for illustrative purposes only and forming no part of the invention.

In the drawings, a brush wiper and holder (hereinafter "brush holder") according to the present invention is indicated generally by the reference numeral 10. The brush holder 10 comprises a lip and a short, cylindrical sidewall 11 with an inner surface 17, whose diameter is slightly larger than that of a conventional paint can 20.

Figure 2:
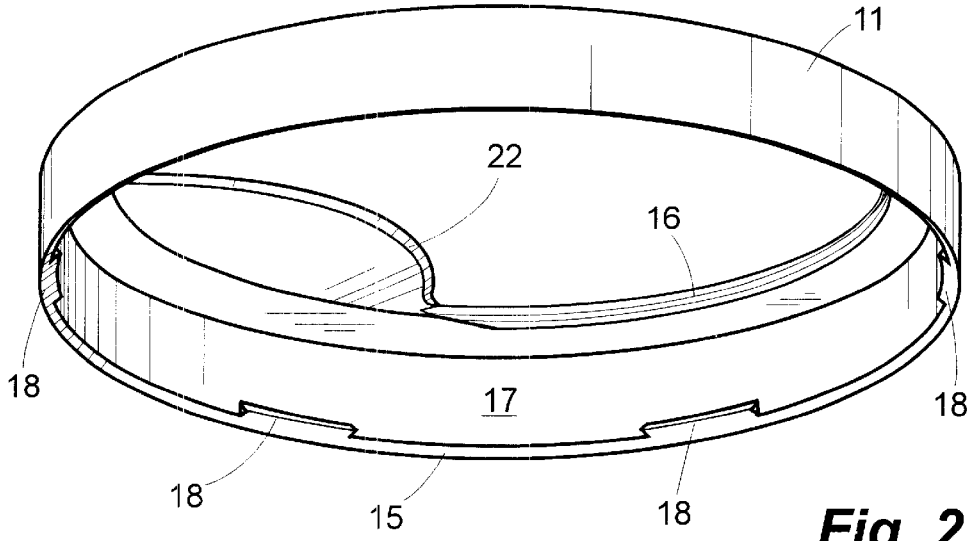
FIG. 2 is a perspective view looking up from the bottom right side of the brush wiper and holder according to FIG. 1.
Figure 3:
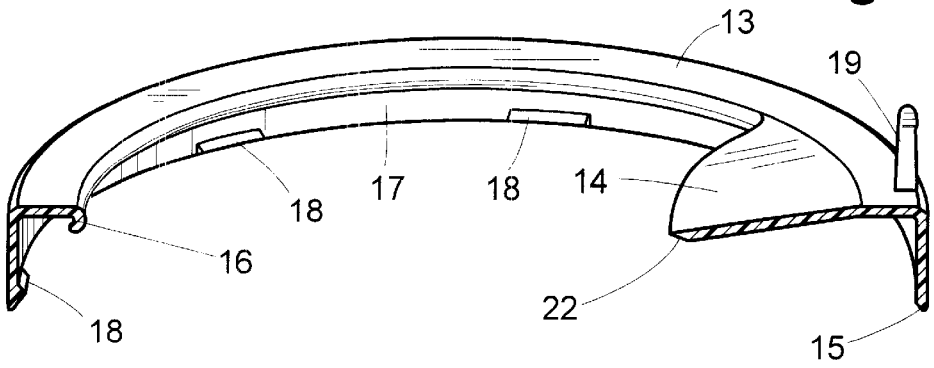
FIG. 3 is a cross-sectional view taken alone line 3—3 of FIG. 1.
Figure 4:
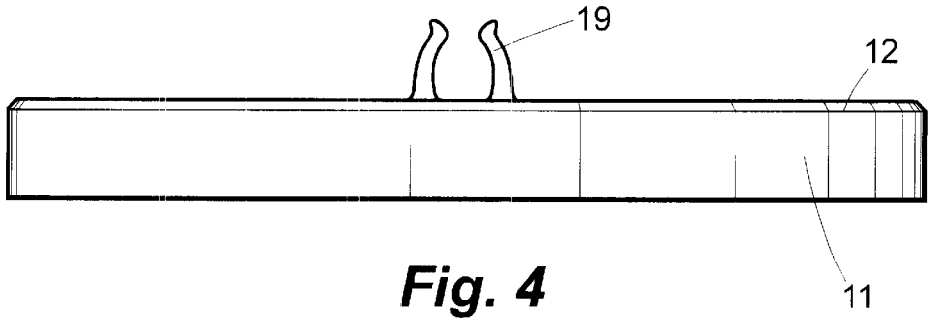
FIG. 4 is a side elevational view of the brush wiper and holder according to FIG. 1.

Extending generally perpendicularly to the sidewall 11, the lip includes an annular ring 13 and a promontory-like protrusion 14 joined to a short section of the ring (FIGS. 1 and 3). Except along the short section, the ring 13, which is of smaller inner diameter than the central opening in the paint can 20, is bounded by a downwardly turned rim 16 (FIGS. 2 and 3).

The protrusion 14, which slopes downwardly from its juncture with the short section, defines an arcuate, generally convex inner edge 22, the distal ends of which intersect the rim 16 (FIGS. 1 through 3). Together the inner edge 22 and the rim 16 define an asymmetrical opening which is disposed within the annular ring 13. In use, any paint dripping on either the ring 13 or the protrusion 14 drains over the lip into the open paint can 20 and not onto the rim of the can.

Similarly, underside of the protrusion 14 is beveled away from the asymmetrical opening at an angle of about 45 degrees, so that paint droplets, which might otherwise tend to accumulate there, encounter a path along which they can slide downwardly over the edge 22 and drip into the open can 20. Moreover, coupled with the generally convex shape of the edge 22, its sharpness enhances the efficiency of the protrusion 14 as a brush wiper. Stroking the bristles of a paint brush across the sharpened, convex portion of the edge 22 not only scrapes excess paint off the bristles but also subjects them to a superior wiping action in which they are spread apart, fan-like, to release excess paint.

Affixed to the upper surface of the ring 13 near its outer periphery and projecting upwardly therefrom is a pair of bowed plastic arms 19 which exhibit leaf spring action or similar releasable fasteners. Spaced apart from each other, the plastic arms 19 hold a paint brush handle firmly in place, when its handle 21 is inserted therebetween. In the preferred embodiment, the arms 19 extend upwardly from the ring 13 a distance which measures, by way of example, about one inch.

The paint brush can be removed from the arms 19 by grasping the handle 21 and rotating it upwardly, thereby pressing its bristles against the edge 22. This action allows one to dislodge the handle 21 from the arms 19 without jerking the brush, thereby reducing the likelihood that paint would be accidentally discharged from the brush.

So that the brush wiper 10 fits snugly against the paint can 20, small protrusions 18 are spaced apart at regular intervals along the bottom edge of the inner surface 17 (FIG. 2). The lip, the sidewall 11 and the protrusions 18 are preferably molded integrally out of plastic to form a single, unitary structure. In the preferred embodiment, the sidewall 11 and the small protrusions 18 measure, by way of example, about 0.050 inch and 0.060 inch in thickness, respectively.

As is illustrated in FIG. 3, the juncture between the sidewall 11 and the lip preferably defines a short bevel 12 of about 45 degrees. The bottom edge 15 of the sidewall 11 is also chamfered at an angle of about 45 degrees, so that when holders 10 are stacked, the bottom edge 15 of the sidewall of one holder fits into the bevel 12 of the wiper stored directly below it.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A device adapted for use with a paint brush and a paint can, the paint can being generally cylindrical in shape, which comprises:

(a) a short, generally cylindrical sidewall, the sidewall having an inner surface which is slightly larger in diameter than the outer diameter of the paint can;

(b) a lip which is joined to the sidewall and extends inwardly generally perpendicularly thereto, and covers all the uppermost top surfaces of the paint can when it is open, the lip including a promontory-like brush rest section with an arcuate, generally convex leading edge, so that bristles of the brush, when pressed against the said leading edge, spread apart fan-like, releasing paint; the brush rest section sloping downwardly slightly, so that any paint collected thereon can drain into the paint can when open;

(c) the arcuate front edge being sharpened, the edge sloping downwardly and outwardly at an angle of approximately 45 degrees, so that paint scraped from the brush tends to flow away from upper portions of the arcuate front surface and drip into the open paint can; and (d) means attached to the lip for holding the paint brush with its bristles disposed generally horizontally above the promontory-like brush rest section.

2. The device according to claim 1, which further comprises a plurality of small protrusions affixed to the cylindrical sidewall proximate with its bottom edge, contiguous protrusions being spaced apart along said bottom edge, so that the small protrusions fit tightly against the sidewall when the sidewall is mounted on the paint can.

3. The device according to claim 1, wherein the sidewall defines space for advertising display, so that the device can be used as an inducement to buy paint.

* * * * *